US007216585B2

(12) United States Patent
Callahan et al.

(10) Patent No.: US 7,216,585 B2
(45) Date of Patent: May 15, 2007

(54) SHAFTLESS MOTOR DRIVE FOR A PRINTING PRESS WITH AN ANILOX INKER

(75) Inventors: Martin John Callahan, Dover, NH (US); Stephen Franklin, Barrington, NH (US)

(73) Assignee: Goss International Americas, Inc., Dover, NH (US)

( * ) Notice: Subject to any disclaimer, the term of this patent is extended or adjusted under 35 U.S.C. 154(b) by 794 days.

(21) Appl. No.: 09/768,736

(22) Filed: Jan. 24, 2001

(65) Prior Publication Data

US 2002/0096066 A1 Jul. 25, 2002

(51) Int. Cl.
*B41F 5/16* (2006.01)

(52) U.S. Cl. ..... 101/183; 101/220

(58) Field of Classification Search ..... 101/183, 101/187, 220, 216, 218, 219, 221, 242, 247, 101/349, 348, 217, 34
See application file for complete search history.

(56) References Cited

U.S. PATENT DOCUMENTS

| | | | | | |
|---|---|---|---|---|---|
| 3,732,815 | A | * | 5/1973 | Greiner et al. | 101/220 |
| 5,165,341 | A | * | 11/1992 | John et al. | 101/217 |
| 5,351,616 | A | * | 10/1994 | Gelinas et al. | 101/218 |
| 5,610,491 | A | | 3/1997 | Gotz et al. | 318/625 |
| 5,656,909 | A | | 8/1997 | Gotz et al. | 318/625 |
| 5,668,455 | A | | 9/1997 | Gotz et al. | 318/602 |
| 5,704,288 | A | | 1/1998 | John | 101/216 |
| 5,782,182 | A | | 7/1998 | Ruckmann et al. | 101/177 |
| 5,826,505 | A | * | 10/1998 | Volz et al. | 101/183 |
| 5,950,538 | A | * | 9/1999 | Puschnerat | 101/217 |
| 5,979,317 | A | * | 11/1999 | Singler | 101/218 |
| 5,983,794 | A | | 11/1999 | Emery | 101/217 |
| 6,019,039 | A | * | 2/2000 | Knauer et al. | 101/218 |
| 6,041,706 | A | * | 3/2000 | Murray | 101/247 |
| 6,050,185 | A | | 4/2000 | Richards | 101/142 |
| 6,186,064 | B1 | * | 2/2001 | Dufour | 101/181 |
| 6,205,926 | B1 | * | 3/2001 | Dufour | 101/492 |
| 6,216,593 | B1 | * | 4/2001 | Tessler | 101/373 |
| 6,334,389 | B1 | * | 1/2002 | Fischer | 101/219 |
| 6,374,731 | B1 | * | 4/2002 | Walczak et al. | 101/142 |

FOREIGN PATENT DOCUMENTS

| | | |
|---|---|---|
| DE | 195 21 827 A1 | 12/1996 |
| EP | 0644 048 A2 | 3/1995 |
| EP | 0699524 | 3/1996 |
| WO | 9524314 | 9/1995 |

* cited by examiner

*Primary Examiner*—Anthony H. Nguyen
(74) *Attorney, Agent, or Firm*—Davidson, Davidson & Kappel, LLC

(57) ABSTRACT

An offset printing press includes a first plate cylinder, a first blanket cylinder for selectively contacting the first plate cylinder, an anilox inker for inking the first plate cylinder, and a first motor directly connected to the anilox inker for driving the anilox inker and connected to the first plate cylinder for driving the first plate cylinder. A second print couple has a second plate cylinder and a second blanket cylinder for selectively contacting the second plate cylinder. A second anilox inker inks the second plate cylinder and a second motor directly connected to the second anilox inker drives the second anilox inker and is connected to the second plate cylinder for driving the second plate cylinder. Blanket cylinders are either driven by their own third motor or via gear transmission from the first or second motors.

7 Claims, 7 Drawing Sheets

SHAFTLESS MOTOR DRIVE FOR A PRINTING PRESS WITH AN ANILOX INKER

BACKGROUND OF THE INVENTION

1. Field of the Invention

The present invention relates generally to printing presses and more particularly to a device and method for driving rolls and cylinders in a printing press.

2. Background Information

Offset lithographic printing presses typically have a plate cylinder carrying an imaged plate. During printing, the plate is inked, and the inked image is transferred to a blanket which then contacts paper sheets or a continuous web of paper. Ink for the plate cylinder may be provided via an anilox inker, which has an anilox roller having a series of cells for providing ink via a roller to a plate cylinder.

The drive for an offset lithographic printing press traditionally has included a common drive shaft running on a gear side of the printing press, with worm gears and other gears deriving power from the shaft.

Other shaftless drive configurations for lithographic offset printing presses use direct or indirect drive motors, which supply the necessary driving forces to the plate and/or blanket cylinders using one to four motors. A separate or additional motor typically is used to drive the ink fountain.

Commonly-owned U.S. Pat. No. 6,050,185, issued Apr. 18, 2000, purports to disclose a shaftless drive with a first drive motor driving a first inker roller either directly or via a further drive. The first drive motor is mechanically coupled to the first plate cylinder via a first gear train, which may include a gear wheel mounted to the drive shaft of the first plate cylinder. A second drive motor drives another plate cylinder and inker roller. The first blanket cylinder and the second blanket cylinder of the press are mechanically coupled to one another and are driven by a third drive motor.

The '185 patent does not disclose an anilox inker, nor does it disclose a two-motor configuration, an inking form roll or an inking roll with a similar diameter to the plate cylinder.

European Patent Application No. 0 699 524 purports to disclose an offset printing machine. Cylinder and functional groups are driven with minimum technical requirements. A printing unit is provided where the plate cylinders are each driven by a separate electric motor and are not mechanically coupled to each other. Independently driven cylinders in a folder are also disclosed.

International Patent Application No. 95/24314 and related U.S. Pat. No. 5,782,182 purport to disclose a printing group for a color-printing web-fed rotary press arranged in a bridge design. The bridge units may be symmetrically distributed in the vertical direction and horizontally movable, to achieve a low height. Each unit side has a plate cylinder and a blanket cylinder. An inking unit for the plate cylinder may include, in place of an inking trough and an inking roller, a chamber doctor blade in connection with an anilox roll. The drive of the dampening unit and of the inking unit can function through friction with the plate cylinder, or by means of an individual motor drive of the inking roller and of the dampening agent application roller, or by means of know gear wheel drives. No driving of the plate cylinder through a motor directly driving the inking unit is disclosed. Moreover, when a drive motor is directly connected to the plate cylinder, proper lateral registration is complicated.

BRIEF SUMMARY OF THE INVENTION

The present invention provides a printing unit of an offset printing press comprising:

a first plate cylinder;

a first blanket cylinder for selectively contacting the first plate cylinder;

an anilox inker for inking the first plate cylinder;

a first motor directly connected to the anilox inker for driving the anilox inker and connected to the first plate cylinder for driving the first plate cylinder;

a second plate cylinder;

a second blanket cylinder for selectively contacting the second plate cylinder;

a second anilox inker for inking the second plate cylinder; and a second motor directly connected to the second anilox inker for driving the second anilox inker and connected to the second plate cylinder for driving the second plate cylinder.

The anilox inkers preferably include an ink form roll and an anilox roll with an ink chamber, the motors directly driving the respective ink form rolls.

The ink form roll preferably has the same diameter as the plate cylinders, thereby improving drive characteristics. The anilox roll may be smaller than or similar to the plate cylinder diameter.

In a first embodiment, the printing press includes a third motor for driving the first and second blanket cylinders. In this embodiment, the first motor drives the first form roll directly, and the anilox roll and the first plate cylinder through a set of gears, and the second motor drives the second form roll directly and the second anilox roll and the second plate cylinder through a second set of gears.

The blanket cylinders are driven by the third motor through a third set of gears, which may include the blanket cylinder being directly geared with two gears together, the motor driving one of the gears. Alternately, each blanket cylinders may have a separate gear separate from the other, with each gear being driven by the third motor.

The plate cylinders can be separated from the blanket cylinders during throwoff since the three sets of gears are separate, and each plate cylinder/blanket cylinder combination can remain printing while the other plate cylinder is thrown off.

In a second embodiment, the first and second motors also drive the blanket cylinders. The anilox inkers are driven directly, and a first gear connected to the motor drives the first plate cylinder and a second gear connected to the second motor drives the second plate cylinder. The first and second blankets are connected to a third and fourth gear, respectively. When both print couples are printing, one of the first and second gears drives the third and fourth gears, so that all cylinders are driven.

To permit throwoff of the first plate cylinder, the first gear and the third gear can be disengaged, while the second gear drives the third and fourth gears. The second plate cylinder can remain in a printing mode. To permit throwoff of the second plate cylinder, the second and fourth gears can be disengaged. The first plate cylinder then still can print.

Preferably, the first and second gears are axially movable with respect to their respective plate cylinders, so as to permit the disengagement from the third and fourth gears, respectively.

The present invention also provides a method for driving a printing unit having a first anilox inker, a first plate cylinder, a first blanket cylinder selectively contacting the first plate cylinder, a second blanket cylinder, a second plate cylinder selectively contacting the second plate cylinder, and a second anilox inker, the method comprising the steps of:

directly driving the first anilox inker using a first motor;

indirectly driving the first plate cylinder using the first motor;

directly driving the second anilox inker using a second motor; and indirectly driving the second plate cylinder using the second plate cylinder.

The method may further include driving the first and second blanket cylinders with one of the first and second motors, or with a third motor.

When contact is removed between the first plate cylinder and first blanket cylinder, the second plate cylinder, second anilox inker and first and second blanket cylinders are capable of continued operation. When contact is removed between the second blanket cylinder and the second plate cylinder, the first anilox inker and first and second blanket cylinders are capable of continued operation.

BRIEF DESCRIPTION OF THE DRAWINGS

Preferred embodiments of the present invention are described below by reference to the following drawings, in which.

DETAILED DESCRIPTION

Figure 1:
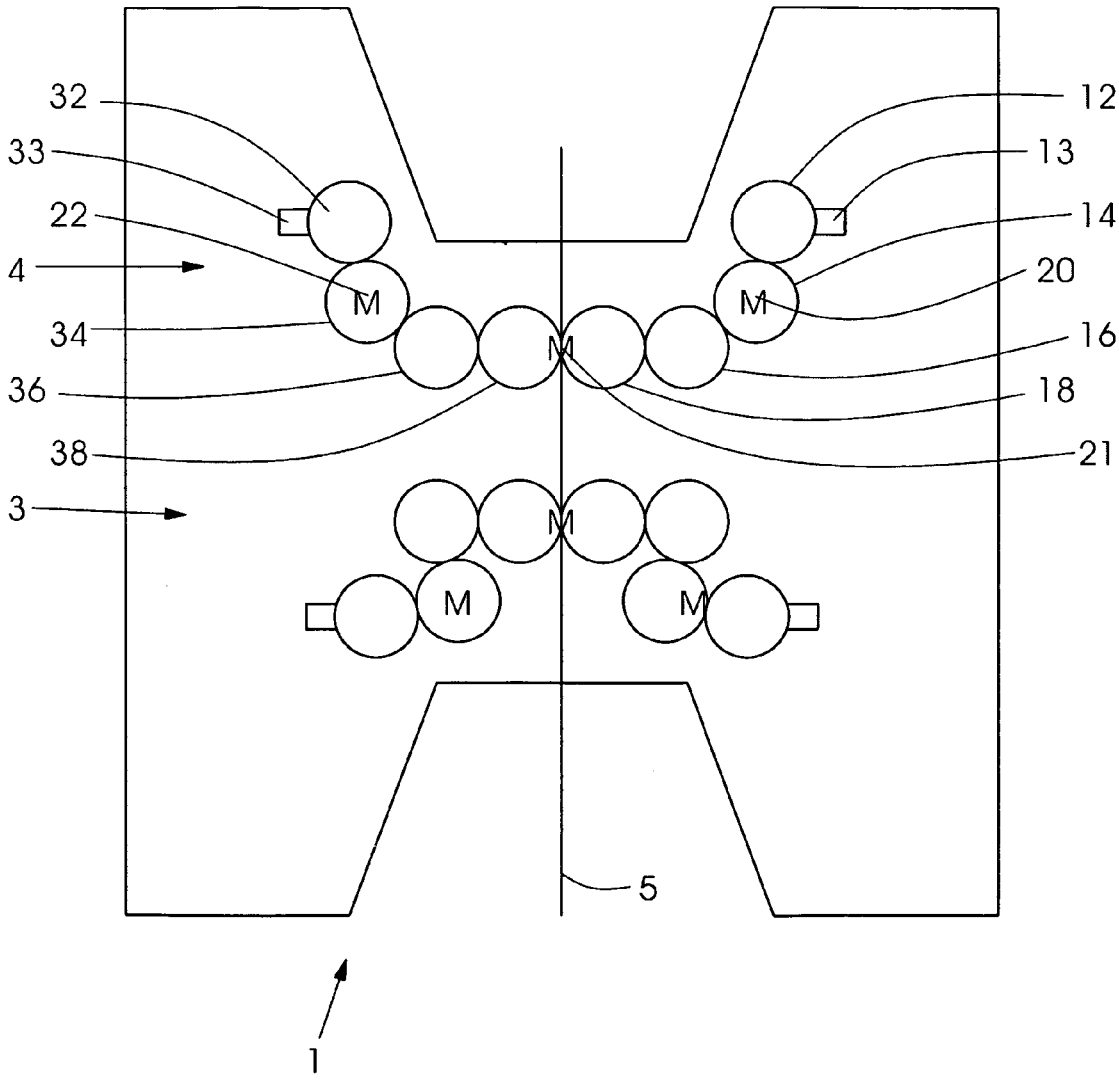
FIG. 1 shows a side view of a first embodiment of a double print unit of a printing press according to the present invention.

FIG. 1 shows a gear side of one embodiment of a printing press 1 having two shaftless printing units 3 and 4. A web 5 is printable on both sides by the lithographic offset printing units 3, 4. Printing unit 4 includes a first print couple having a plate cylinder 16 and a blanket cylinder 18. An anilox roll 12 with an ink chamber 13 and an ink form roll 14, which together define an anilox inker, provide ink to the plate cylinder 16. Print unit 4 has a second printing couple having a plate cylinder 36 and a blanket cylinder 38. The blanket cylinders 18 and 38 function as impression cylinders for each other, and are in contact with the web when either or both of the print couples is printing.

Figure 3:
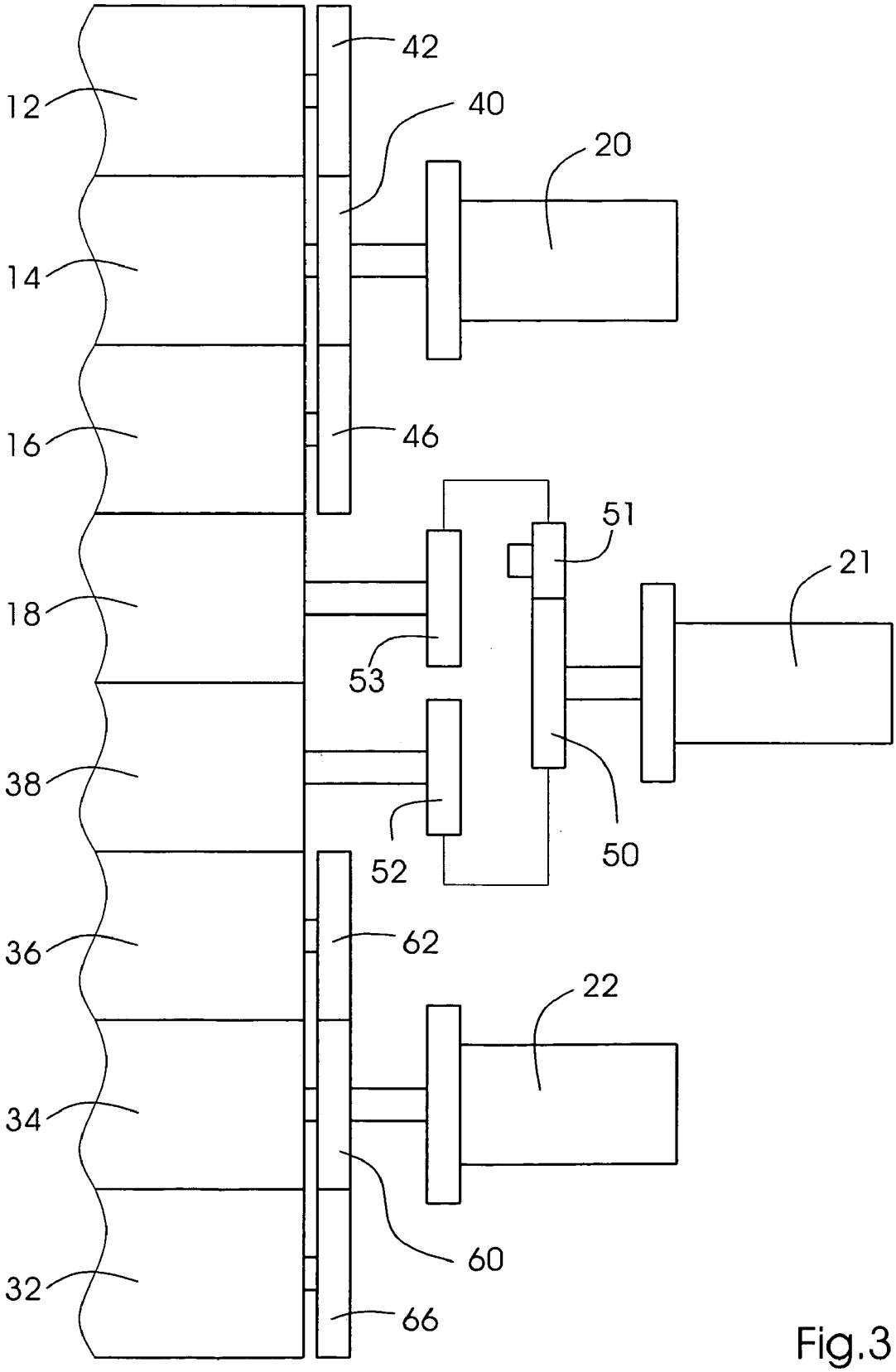
FIG. 3 shows a partial view of one print unit of the configuration of the embodiment of FIG. 1.

In press 1, the anilox inker for plate cylinder 16 is driven at the ink form roll 14 by a motor 20, which drives an axle of the roll 14. As shown in FIG. 3, a gear 40 on the axle of the cylinder 14 connects with a gear 42 on an axle of the anilox roll 12 and with a gear 46 on an axle of the plate cylinder 16. Motor 20 thus drives rolls 12, 14 and cylinder 16. Ink form roll 14 and plate cylinder 16 preferably are of the same diameter. The anilox inker has the advantage that pre-inking of plate cylinder 16 can occur prior to moving the plate cylinder 16 back into contact with blanket cylinder 18 after throwoff. No ink keys need to be adjusted with the anilox inker, and the proper ink coverage can be provided on the web 5 with the first rotation of the blanket cylinder 18.

Blanket cylinders 18 and 38 are driven by a motor 21 which is connected to a gear 50. Gear 50 drives a gear 51 in one side, which then drives a gear 53 on a shaft of blanket cylinder 18. Gear 50 drives another gear 52 on the shaft of blanket cylinder 38. Gears 52 and 53 are not in contact.

Another motor 22 drives the axle of ink form roller 34, on which axle is a gear 60 driving gears 62 and 66. Gears 62 and 66 drive the plate cylinder 36 and the anilox roll 32, respectively.

Plate cylinders 16 and 36 can pivot away from blanket cylinders 18, 38, respectively, during a throwoff operation. Since motors 20, 21, 22 are independent, print couple 16, 18 and blanket cylinder 38 can be run when plate cylinder 36 is thrown off, and print couple 36, 38 and blanket cylinder 18 can be run when plate cylinder 36 is thrown off. Thus printing can continue with one print color while the other plate cylinder is, for example, provided with a new image.

Figure 4:
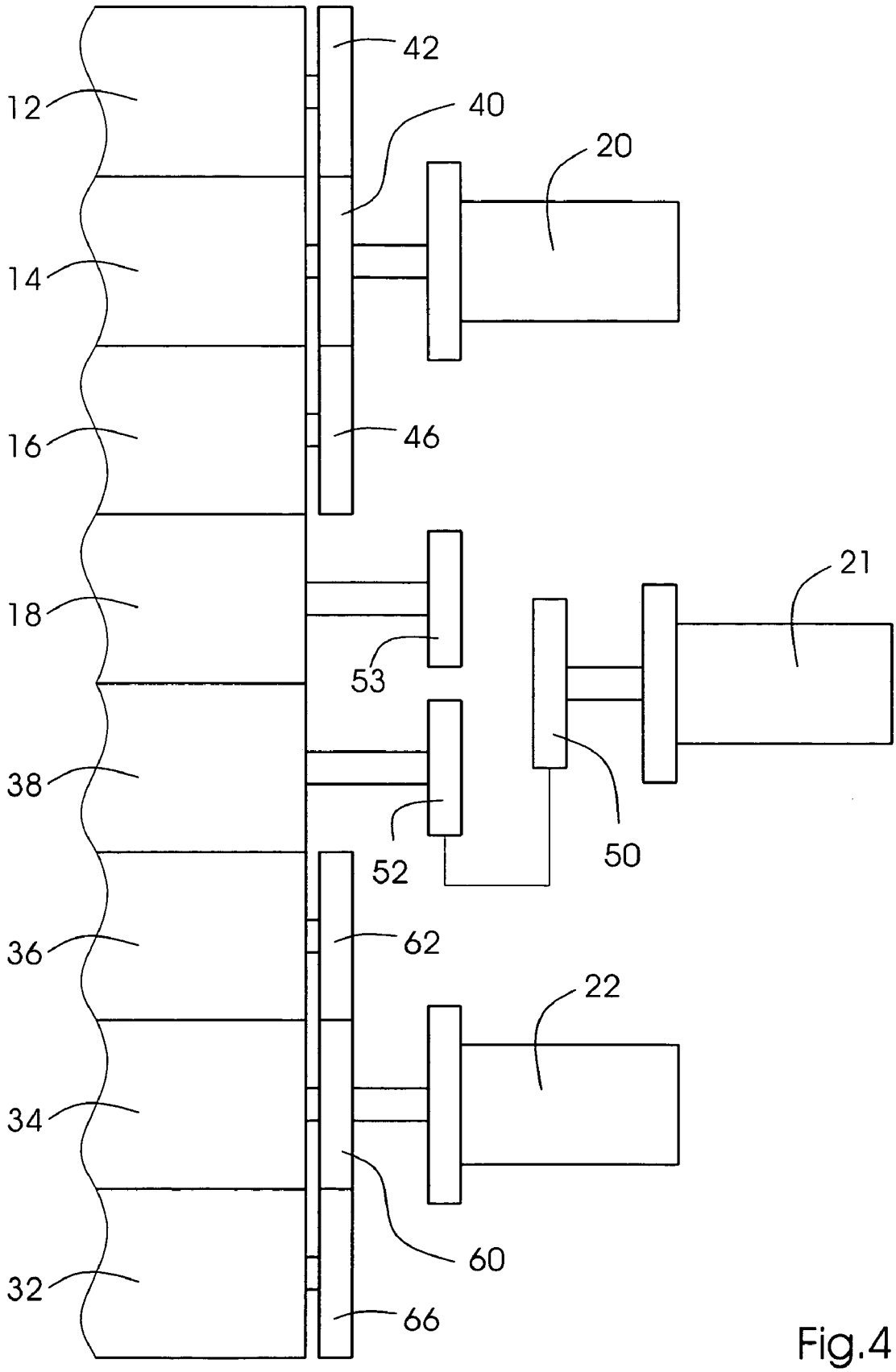
FIG. 4 shows a partial view of one print unit of another configuration of the embodiment of FIG. 1.

FIG. 4 shows an alternate configuration of FIG. 3 where the motor 21 drives gear 50, which drives gear 52 as in FIG. 3. However, gear 52 then drives gear 53 to drive blanket cylinder 18. While the FIG. 4 configuration requires fewer gears, the power distribution in the FIG. 3 configuration may be more desirable.

Figure 2:
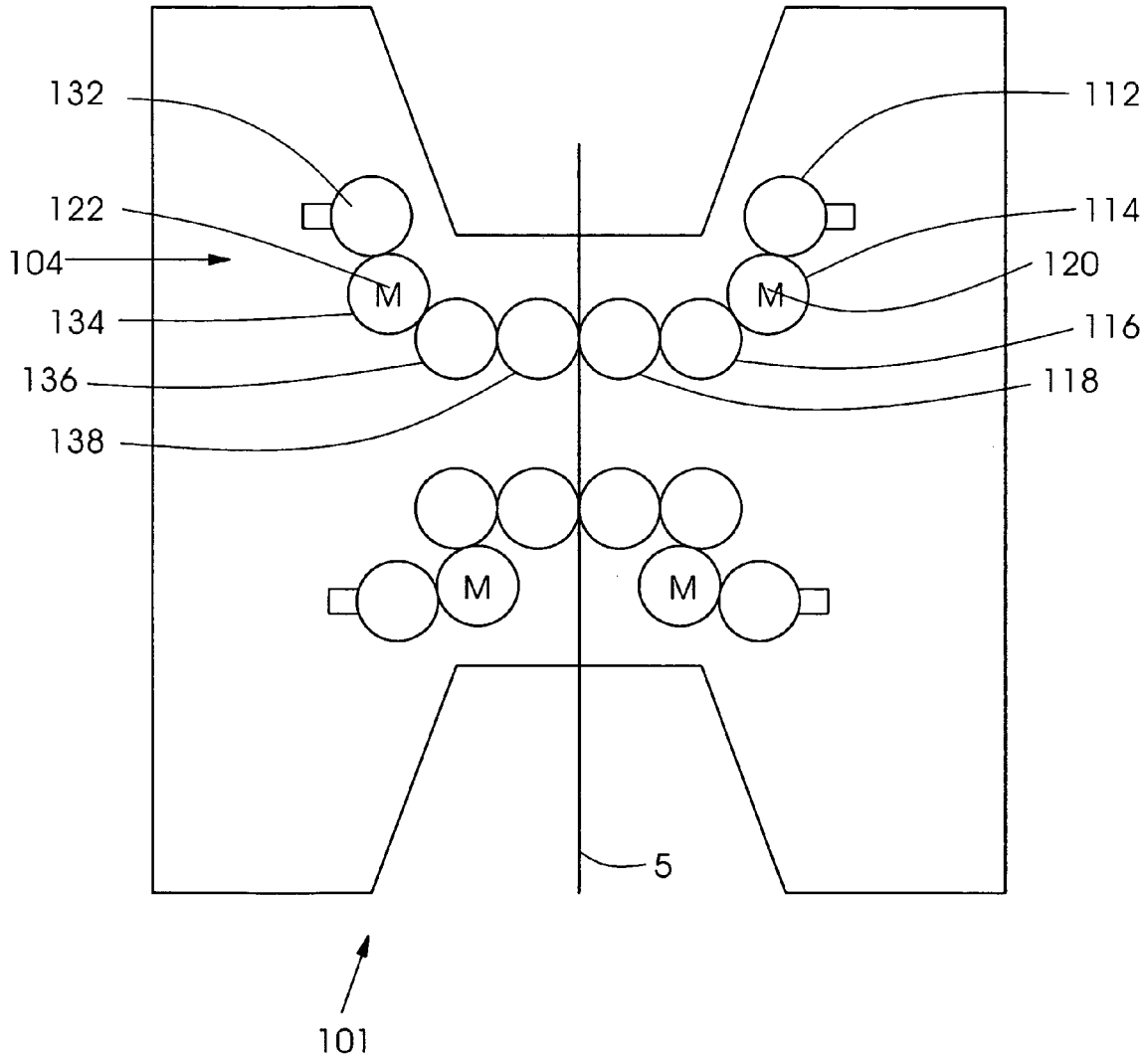
FIG. 2 shows a side view of a second embodiment of a double print unit of a printing press according to the present invention.

FIG. 2 shows an alternate two-motor embodiment of a printing press 101 according to the present invention. While the three-motor configuration of FIG. 1 provides more balanced loads, the two-motor configuration reduces the number of motors required. Printing unit 104 of printing press 101 includes a first print couple having a plate cylinder 116 and a blanket cylinder 118. An anilox roll 112 with an ink chamber 113 and an ink form roll 114, which together define an anilox inker, provide ink to the plate cylinder 116. Print unit 104 has a second printing couple having a plate cylinder 136 and a blanket cylinder 138. The blanket cylinders 118 and 138 function as impression cylinders for each other, and are in contact with the web when either or both of the print couples is printing.

In press 101, the anilox inker for plate cylinder 116 is driven at the ink form roll 114 by a motor 120, which drives an axle of the roll 114.

Figure 5:
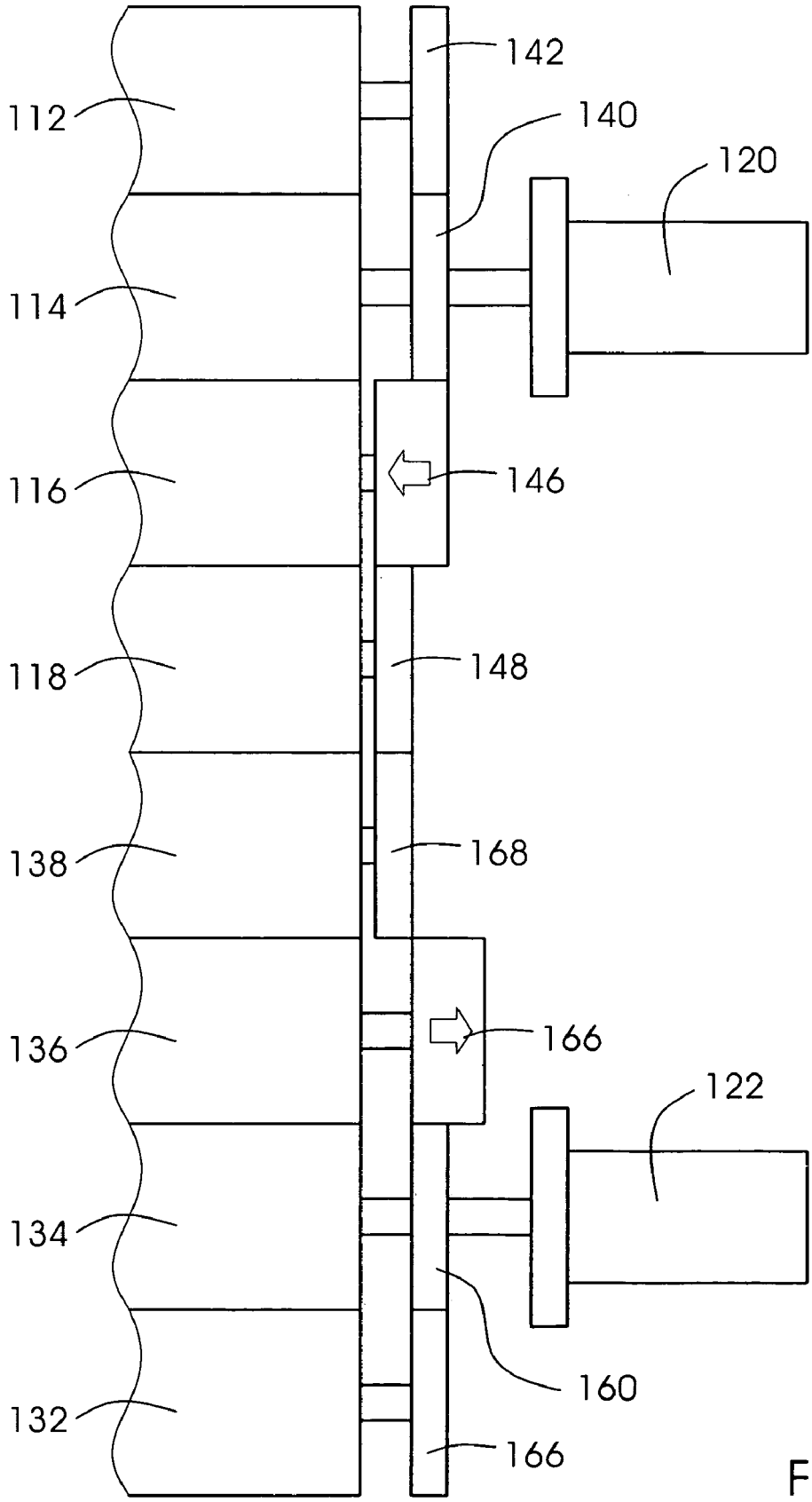
FIG. 5 shows a partial view of one print unit of the embodiment of FIG. 2 with both print couples printing.

As shown in FIG. 5, a gear 140 on the axle of ink form roll 114 connects with a gear 142 on an axle of the anilox roll 112 and with a gear 146 on an axle of the plate cylinder 116. Motor 120 thus drives rolls 112, 114 and cylinder 116. The ink form roll 114 and the plate cylinder 116 preferably are of the same diameter, so as to provide better force and ink distribution. Gear 146 also is movable axially with respect to cylinder 116, so as to be selectively engageable with a gear 148 connected to blanket cylinder 118. Gear 148 is geared to gear 168 of blanket cylinder 138.

Another motor 122 drives the axle of ink form roller 134, on which axle is a gear 160 driving gears 162 and 166. Gears 162 and 166 drive the plate cylinder 36 and the anilox roll 132, respectively. Gear 166 is selectively engageable with gear 168, but in FIG. 5, gear 168 is not in contact with gear 166. So, gear 166 is driven by motor 122 and gear 168 by motor 120.

Figure 6:
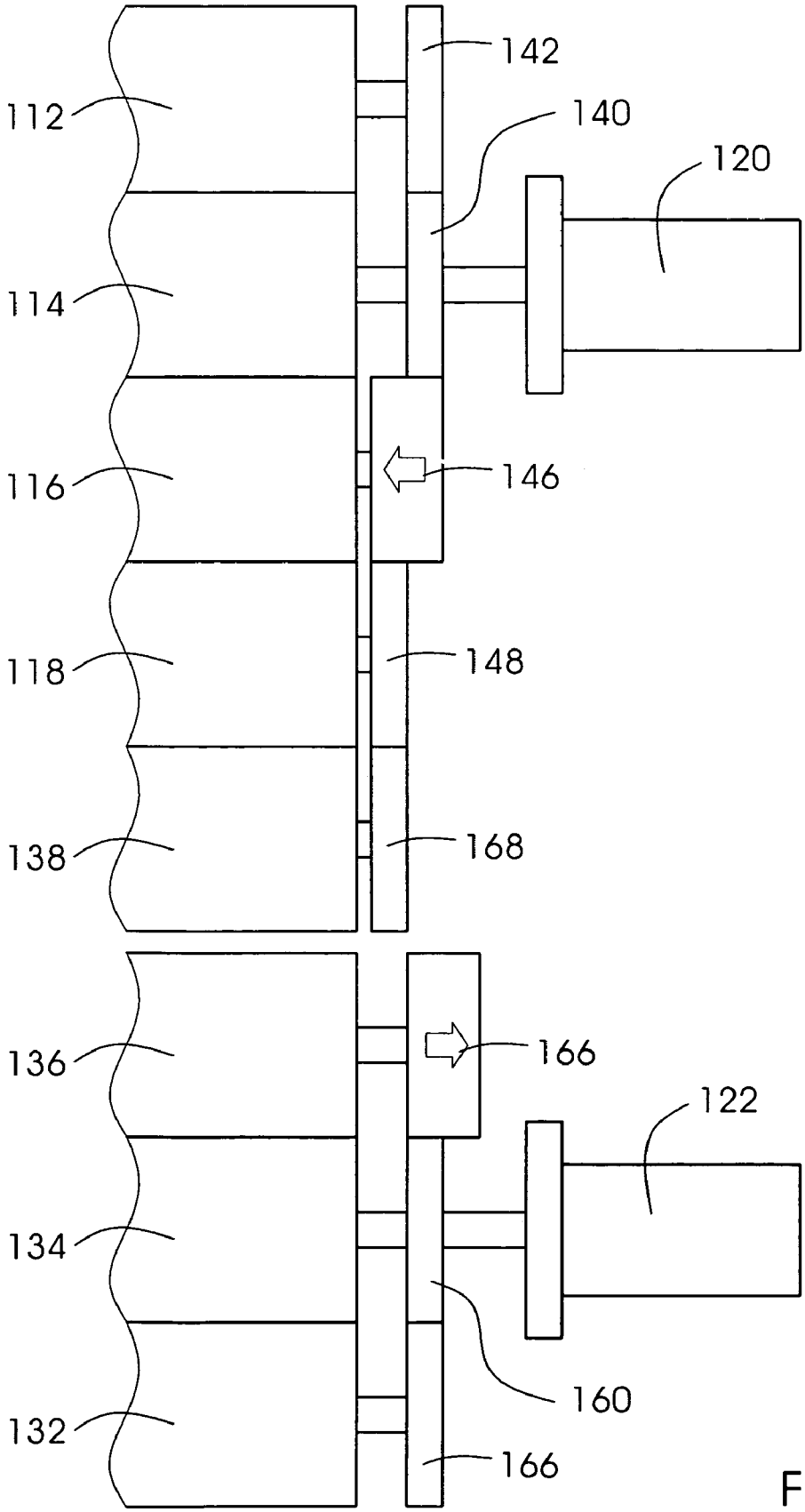
FIG. 6 shows a partial view of one print unit of the embodiment of FIG. 2 with the right print couple printing.

FIG. 6 shows plate cylinder 136 thrown off of blanket cylinder 138 and gear 166 disengaged from gear 168. Motor 120 drives rolls 112 and 114 and cylinders 116, 118 and 138.

Figure 7:
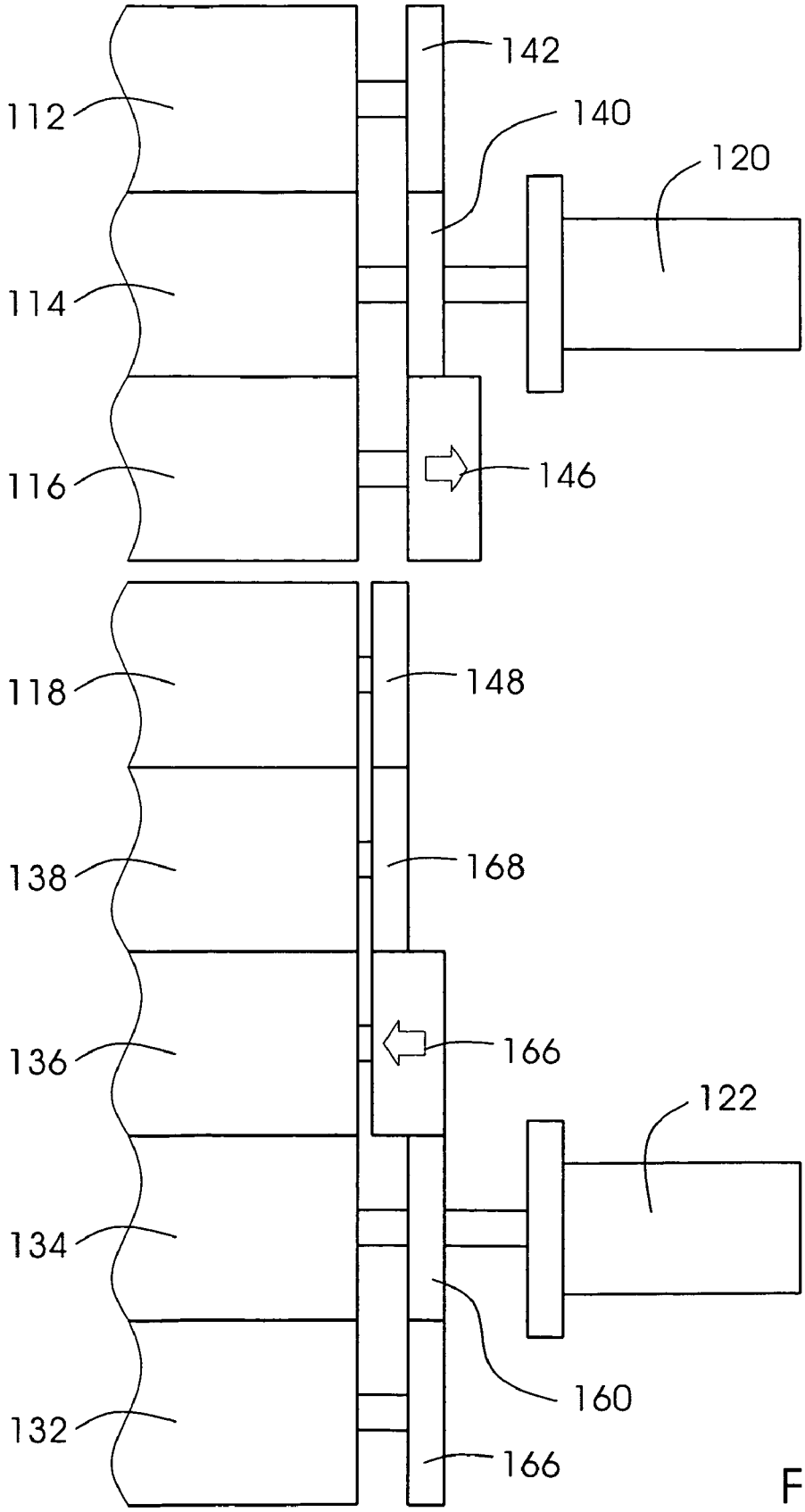
FIG. 7 shows a partial view of one print unit of the embodiment of FIG. 2 with the left print couple printing.

FIG. 7 shows plate cylinder 116 thrown off blanket cylinder 118, with gears 146 and 148 disengaged. Motor 122 drives rolls 132 and 134 and cylinders 136, 138 and 118.

In addition to the plate cylinder-blanket cylinder throwoff, the ink form roll also may be thrown off its respective plate cylinder or off its respective anilox roll. "Plate cylinder" as defined herein may include any image-carrying cylinder.

What is claimed is:

1. An offset printing press comprising:

a first plate cylinder;

a first blanket cylinder for selectively contacting the first plate cylinder;

an anilox inker for inking the first plate cylinder;

a first motor directly connected to the anilox inker for driving the anilox inker and connected to the first plate cylinder for driving the first plate cylinder;

a second plate cylinder;

a second blanket cylinder for selectively contacting the second plate cylinder;

a second anilox inker for inking the second plate cylinder; and a second motor directly connected to the second anilox inker for driving the second anilox inker and connected to the second plate cylinder for driving the second plate cylinder, further comprising a third motor for driving the first and second blanket cylinders, wherein the first and second blanket cylinders have direct gears separated from the other, with each direct gear being driven by the third motor.

2. An offset printing press comprising:

a first plate cylinder;

a first blanket cylinder for selectively contacting the first plate cylinder;

an anilox inker for inking the first plate cylinder;

a first motor directly connected to the anilox inker for driving the anilox inker and connected to the first plate cylinder for driving the first plate cylinder;

a second plate cylinder;

a second blanket cylinder for selectively contacting the second plate cylinder;

a second anilox inker for inking the second plate cylinder; and a second motor directly connected to the second anilox inker for driving the second anilox inker and connected to the second plate cylinder for driving the second plate cylinder, wherein one of the first and second motor drives the first and second blanket cylinders.

3. The press as recited in claim 2 wherein the first anilox inker includes an ink form roll and the second anilox inker a second ink form roll, and wherein in a first mode the ink form roll is driven directly by the first motor, and the first plate cylinder, first blanket cylinder and second blanket cylinder are driven indirectly by the first motor.

4. The press as recited in claim 3 wherein the second plate cylinder is thrown off of the second blanket cylinder.

5. The press as recited in claim 3 wherein in a second mode the second motor drives the second ink form roller, the second plate cylinder, and the first and second blanket cylinders.

6. The press as recited in claim 5 wherein the first plate cylinder is thrown off of the first blanket cylinder.

7. A method for driving a printing unit having a first anilox inker, a first plate cylinder, a first blanket cylinder selectively contacting the first plate cylinder, a second blanket cylinder, a second plate cylinder selectively contacting the second blanket cylinder, and a second anilox inker, the method comprising the steps of:

directly driving the first anilox inker using a first motor;

indirectly driving the first plate cylinder using the first motor;

directly driving the second anilox inker using a second motor; and indirectly driving the second plate cylinder using the second motor, including driving the first and second blanket cylinders with one of the first and second motors.

* * * * *